US011146887B2

(12) United States Patent
Winton et al.

(10) Patent No.: US 11,146,887 B2
(45) Date of Patent: Oct. 12, 2021

(54) ACOUSTICAL IN-CABIN NOISE CANCELLATION SYSTEM FOR FAR-END TELECOMMUNICATIONS

(71) Applicant: HARMAN INTERNATIONAL INDUSTRIES, INCORPORATED, Stamford, CT (US)

(72) Inventors: Riley Winton, Opelika, AL (US); Chris Ludwig, Bloomfield Hills, MI (US); Gorm H. Jorgensen, Struer (DK); Lars Goller, Herning (DK); Morten Lydolf, Holstebro (DK)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/958,010

(22) PCT Filed: Dec. 31, 2018

(86) PCT No.: PCT/IB2018/060741
§ 371 (c)(1),
(2) Date: Jun. 25, 2020

(87) PCT Pub. No.: WO2019/130282
PCT Pub. Date: Jul. 4, 2019

(65) Prior Publication Data

US 2021/0067873 A1 Mar. 4, 2021

Related U.S. Application Data

(60) Provisional application No. 62/612,252, filed on Dec. 29, 2017, provisional application No. 62/613,206, filed on Jan. 3, 2018.

(51) Int. Cl.
*H04R 3/00* (2006.01)
*G10L 21/0216* (2013.01)
(Continued)

(52) U.S. Cl.
CPC ..... *H04R 3/005* (2013.01); *G10L 21/0216* (2013.01); *H04R 1/406* (2013.01);
(Continued)

(58) Field of Classification Search
None
See application file for complete search history.

(56) References Cited

U.S. PATENT DOCUMENTS 10,219,072 B1 * 2/2019 Sullivan, Jr. ..... H04R 1/406
2002/0031234 A1 3/2002 Wenger et al.
(Continued)

FOREIGN PATENT DOCUMENTS

DE 10200034237 A1 10/2011
EP 1830348 A1 9/2007

OTHER PUBLICATIONS

EP-0624046-A1, Andrae, Apr. 27, 1994 (translated in English). (Year: 1994).*

*Primary Examiner* — Paul W Huber
(74) *Attorney, Agent, or Firm* — Brooks Kushman, P.C.

(57) ABSTRACT

An in-vehicle noise-cancellation system may optimize far-end user experience. The noise-cancellation system may incorporate real-time acoustic input from the vehicle, as well microphones from a telecommunications device. Audio signals from small, embedded microphones mounted in the vehicle can be processed and mixed into an outgoing telecom signal to effectively cancel acoustic energy from one or more unwanted sources in the vehicle. Multiple microphones may be mounted to headrests and spaced apart in one or more directions to give an indication of the direction of incoming sound from one or more listening zones so that sounds from certain zones may be suppressed. Unwanted noise captured by the embedded microphones may be used as direct inputs to the noise-cancellation system. As direct inputs, these streams can, therefore, be cancelled from the
(Continued)

outgoing telecom signal, thus providing the user's far-end correspondent with much higher signal-to-noise ratio, call quality, and speech intelligibility.

16 Claims, 9 Drawing Sheets

(51) Int. Cl.
*H04R 1/40* (2006.01)
*H04R 3/02* (2006.01)

(52) U.S. Cl.
CPC ..... *H04R 3/02* (2013.01); *G10L 2021/02166* (2013.01); *H04R 2499/13* (2013.01)

(56) References Cited

U.S. PATENT DOCUMENTS

| | | | | |
|---|---|---|---|---|
| 2003/0097257 | A1* | 5/2003 | Amada | G10L 21/0208 704/208 |
| 2006/0147063 | A1 | 7/2006 | Chen | |
| 2006/0269072 | A1 | 11/2006 | Mao | |
| 2011/0054891 | A1* | 3/2011 | Vitte | H04R 3/005 704/233 |
| 2012/0197637 | A1* | 8/2012 | Gratke | G10L 21/02 704/226 |
| 2013/0251159 | A1 | 9/2013 | Buck et al. | |
| 2014/0056435 | A1 | 2/2014 | Kjems et al. | |
| 2015/0325251 | A1 | 11/2015 | Dusan et al. | |
| 2016/0027428 | A1 | 1/2016 | Gul et al. | |
| 2016/0257227 | A1* | 9/2016 | Takada | B60R 11/0247 |
| 2017/0032806 | A1* | 2/2017 | Konjeti | H04R 3/005 |
| 2018/0295443 | A1* | 10/2018 | Takada | B60N 2/80 |
| 2019/0251955 | A1* | 8/2019 | Degraye | H04R 3/005 |

* cited by examiner

ACOUSTICAL IN-CABIN NOISE CANCELLATION SYSTEM FOR FAR-END TELECOMMUNICATIONS

CROSS-REFERENCE TO RELATED APPLICATIONS

This application is the U.S. National Stage of International Application No. PCT/IB2018/060741 filed on Dec. 31, 2018, which claims the benefit of U.S. Provisional Application No. 62/612,252, filed Dec. 29, 2017, and U.S. Provisional Application No. 62/613,206, filed Jan. 3, 2018, the disclosures of which are hereby incorporated in their entirety by reference herein.

TECHNICAL FIELD

The present disclosure relates to a system and microphone headrest configurations for cancelling in-cabin noise from a vehicle at a far-end user of a telecommunications system.

BACKGROUND

Current vehicle cabin acoustics predicate that any sound that occurs in the cabin will generally be perceived as one noisy stimulus. Common examples of interference sources include road noise, wind noise, passenger speech, and multimedia content. The presence of these noise sources complicates speech perception by reducing speech intelligibility, signal-to noise ratio, and subjective call quality. Many modern techniques exist to improve the telecommunications experience for the near-end participants (i.e., driver or other occupants of the source vehicle), but thus far nothing has attempted to improve call quality for the far-end participants of telecommunication.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a noise cancellation system for a vehicle including: at least one microphone array having at least two microphones mounted to a first headrest and spaced apart in a longitudinal direction, where a distance separating the two microphones creates at least a first listening zone and a second listening zone, and where the second listening zone is oriented in the longitudinal direction relative to the first listening zone. The noise cancelation system may further include a digital signal processor programmed to: receive microphone signals indicative of sound from the at least one microphone array; and identify whether the sound is received from the first listening zone or the second listening zone based on the microphone signals. Other embodiments of this aspect include corresponding computer systems, apparatus, and computer programs recorded on one or more computer storage devices, each configured to perform the actions of the methods.

Implementations may include one or more of the following features. The microphones may be positioned within the first listening zone, and the digital signal processor may be further programmed to suppress sound received from the second listening zone. The second listening zone may be rearward of the first listening zone. The digital signal processor being programmed to identify whether the sound is received from the first listening zone or the second listening zone may be programmed to: compare the microphone signals from the two microphones; and localize a direction of the sound from either the first listening zone or the second listening zone based on a time difference of arrival of the microphone signals at each of the two microphones. The microphones may be omnidirectional. The microphones may be located on an inboard side surface of the first headrest. Alternatively, the microphones may be located on a bottom surface of the first headrest. The two microphones may be further separated in a lateral direction with respect to the vehicle, and the first listening zone may include two listening subzones oriented in the lateral direction relative to each other. The digital signal processor may be further programmed to suppress sound received from one of the listening subzones.

The noise cancellation system may further include a second microphone array having at least two microphones. The microphones in the second microphone array may be mounted to a bottom surface of a second headrest laterally adjacent to the first headrest. The two microphones in the second headrest may be spaced apart in both the longitudinal direction and the lateral direction.

The noise cancellation system may further include a second microphone array having at least two microphones mounted in a rearview mirror assembly. The at least two microphones in the second microphone array may be spaced apart in a lateral direction with respect to the vehicle. The at least two microphones in the rearview mirror assembly may be directional microphones such that the first listening zone includes two listening subzones oriented in the lateral direction with respect to the vehicle Implementations of the described techniques may include hardware, a method or process, or computer software on a computer-accessible medium.

Another general aspect includes a microphone array for a communications system associated with a vehicle. The microphone array may include: a first microphone mounted adjacent to an external surface of a headrest; and a second microphone mounted adjacent to the external surface of the headrest and spaced-apart from the first microphone in a longitudinal direction. At least a longitudinal distance may separate the first microphone from the second microphone to create at least a first listening zone and a second listening zone oriented in a longitudinal direction with respect to the vehicle.

Implementations may include one or more of the following features. The first microphone and the second microphone may be omnidirectional microphones. The first and second microphones may be located on an inboard side surface of the headrest. Alternatively, the first and second microphones may be located on a bottom surface of the first headrest. The first microphone and the second microphone may be further separated by a lateral distance such that the first listening zone includes two listening subzones oriented in a lateral direction with respect to the vehicle. Another general aspect may include a headrest for a vehicle having a communications system including a headrest body having an external surface and a microphone array. The microphone array may include: a first microphone mounted adjacent to an external surface of a headrest; and a second microphone mounted adjacent to the external surface of the headrest and spaced-apart from the first microphone in a longitudinal direction. At least a longitudinal distance may separate the first microphone from the second microphone to create at least a first listening zone and a second listening zone oriented in a longitudinal direction with respect to the vehicle.

Implementations may include one or more of the following features. The external surface may include an inboard side surface and the first and second microphones may be mounted to the inboard side surface. The external surface may include a bottom surface and the first and second microphones may be mounted to the bottom surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

The present disclosure describes an in-vehicle noise-cancellation system for optimizing far-end user experience. The noise-cancellation system may improve the intelligibility of near-end speech at the far-end of a communications exchange, including a telecommunications exchange or dialogue with a virtual personal assistant, or the like. The noise-cancellation system may incorporate real-time acoustic input from the vehicle, as well microphones from a telecommunications device. Moreover, audio signals from small, embedded microphones mounted in the car can be processed and mixed into an outgoing telecommunications signal to effectively cancel acoustic energy from one or more unwanted sources in the vehicle. Audio playing from a known audio stream (e.g., music, sound effects, and dialog from a film audio) in the vehicle's infotainment system, in addition to unwanted noise (e.g., children yelling and background conversations) captured by the embedded microphones, may be used as direct inputs to the noise-cancellation system. As direct inputs, these streams can, therefore, be cancelled from the outgoing telecommunications signal, thus providing the user's far-end correspondent with much higher signal-to-noise ratio, call quality, and speech intelligibility.

Figure 1:
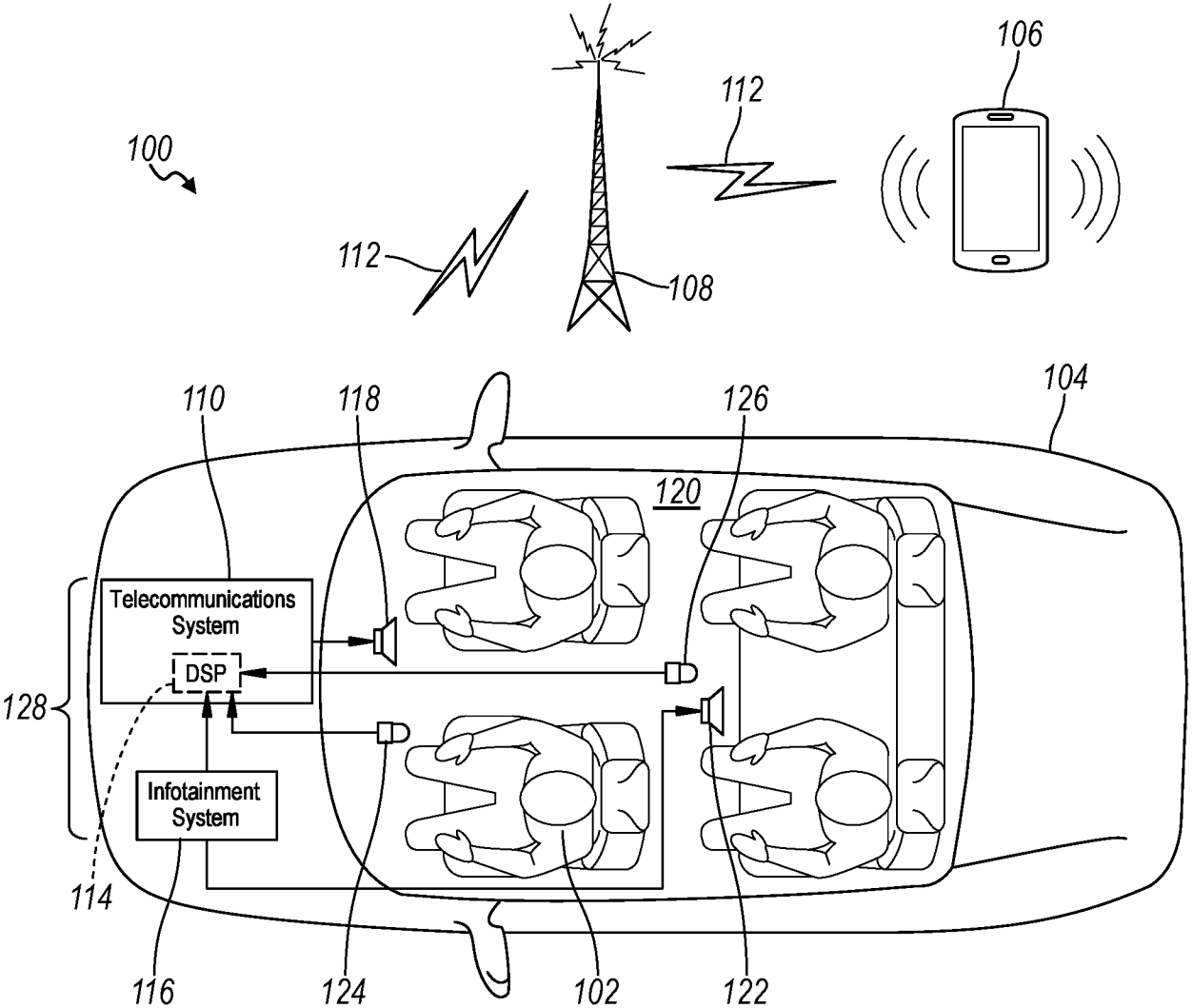
FIG. 1 illustrates a telecommunications network for facilitating telecommunication between a near-end participant in a vehicle and a remote, far-end participant located outside the vehicle, according to one or more embodiments of the present disclosure.

FIG. 1 illustrates a telecommunications network 100 for facilitating a telecommunications exchange between a near-end participant 102 in a vehicle 104 and a remote, far-end participant 106 located outside the vehicle via a cellular base station 108. The vehicle 104 may include a telecommunications system 110 for processing incoming and outgoing telecommunications signals, collectively shown as telecommunications signals 112 in FIG. 1. The telecommunications system 110 may include a digital signal processor (DSP) 114 for processing audio telecommunications signals, as will be described in greater detail below. According to another embodiment, the DSP 114 may be a separate module from the telecommunications system 110. A vehicle infotainment system 116 may be connected to the telecommunications system 110. A first transducer 118 or speaker may transmit the incoming telecommunications signal to the near-end participant of a telecommunications exchange inside a vehicle cabin 120. Accordingly, the first transducer 118 may be located adjacent to a near-end participant or may generate a sound field localized at a particular seat location occupied by the near-end participant. A second transducer 122 may transmit audio from the vehicle's infotainment system 116 (e.g., music, sound effects, and dialog from a film audio).

A first microphone array 124 may be located in the vehicle cabin 120 to receive speech of the near-end participant (i.e., driver or another occupant of the source vehicle) in a telecommunication. A second microphone array 126 may be located in the vehicle cabin 120 to detect unwanted audio sources (e.g., road noise, wind noise, background speech, and multimedia content), collectively referred to as noise.

Collectively, the telecommunications system 110, the DSP 114, the infotainment system 116, the transducers 118, 122, and the microphone arrays 124, 126 may form an in-cabin noise cancellation system 128 for far-end telecommunications.

Figure 2:
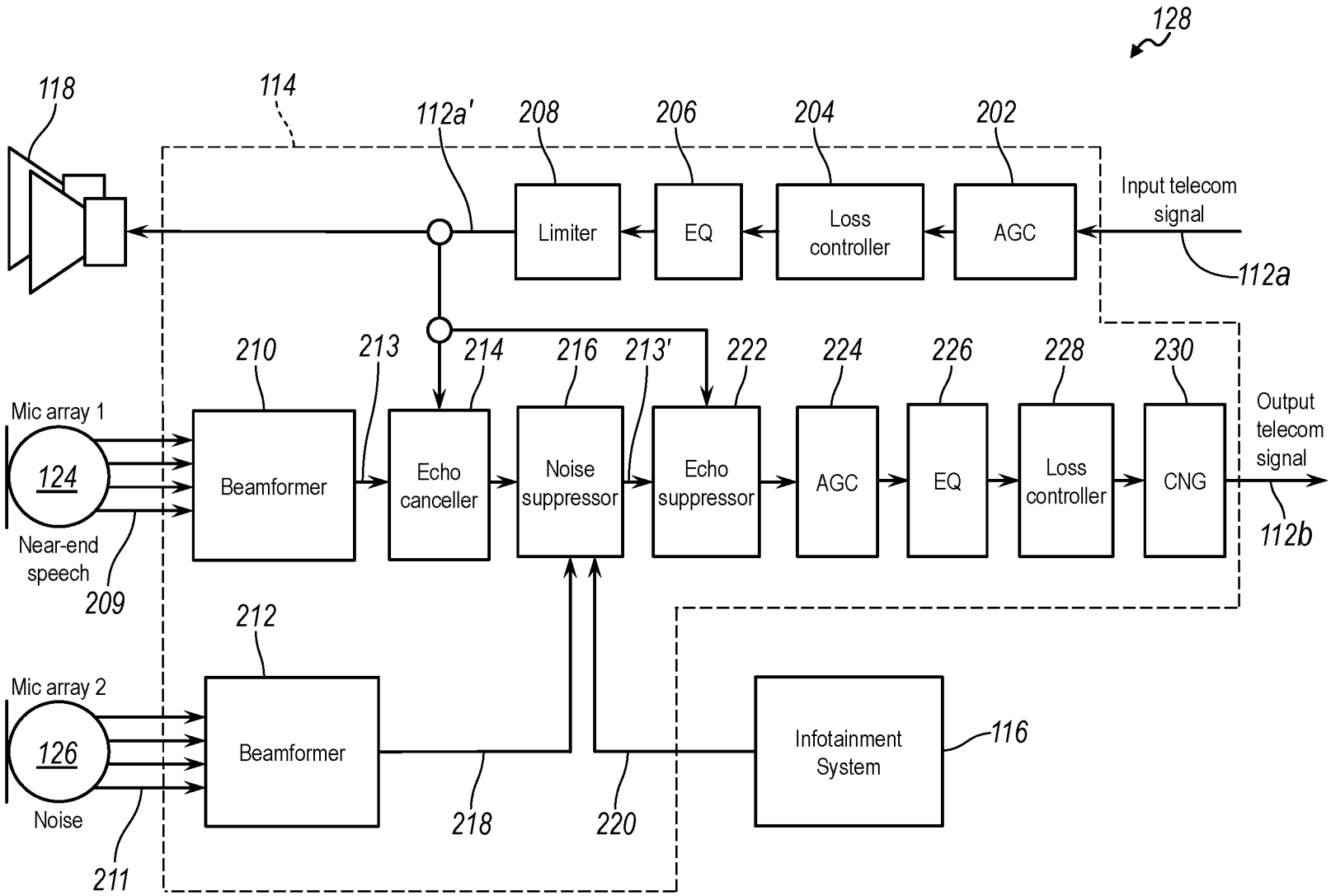
FIG. 2 is a block diagram of an in-cabin noise cancellation system for far-end telecommunications, according to one or more embodiments of the present disclosure.

FIG. 2 is a block diagram of the noise cancellation system 128 depicted in FIG. 1. As show in FIG. 2, an incoming telecommunications signal 112*a* from a far-end participant (not shown) may be received by the DSP 114. The DSP 114 may be a hardware-based device, such as a specialized microprocessor and/or combination of integrated circuits optimized for the operational needs of digital signal processing, which may be specific to the audio application disclosed herein. The incoming telecommunications signal 112*a* may undergo automatic gain control at an automatic gain controller (AGC) 202. The AGC 202 may provide a controlled signal amplitude at its output, despite variation of the amplitude in the input signal. The average or peak output signal level is used to dynamically adjust the input-to-output gain to a suitable value, enabling the circuit to work satisfactorily with a greater range of input signal levels. The output from the AGC 202 may then be received by a loss controller 204 to undergo loss control, which is then passed to an equalizer 206 to equalize the incoming telecommunications signal 112*a*. Equalization is the process of adjusting the balance between frequency components within an electronic signal. Equalizers strengthen (boost) or weaken (cut) the energy of specific frequency bands or "frequency ranges."

The output of the equalizer 206 may be received by a limiter 208. A limiter is a circuit that allows signals below a specified input power or level to pass unaffected while attenuating the peaks of stronger signals that exceed this threshold. Limiting is a type of dynamic range compression; it is any process by which a specified characteristic (usually amplitude) of the output of a device is prevented from exceeding a predetermined value. Limiters are common as a safety device in live sound and broadcast applications to prevent sudden volume peaks from occurring. A digitally processed incoming telecommunications signal 112*a*' may then be received by the first transducer 118 for audible transmission to the near-end participant of the telecommunications exchange.

Figure 4:
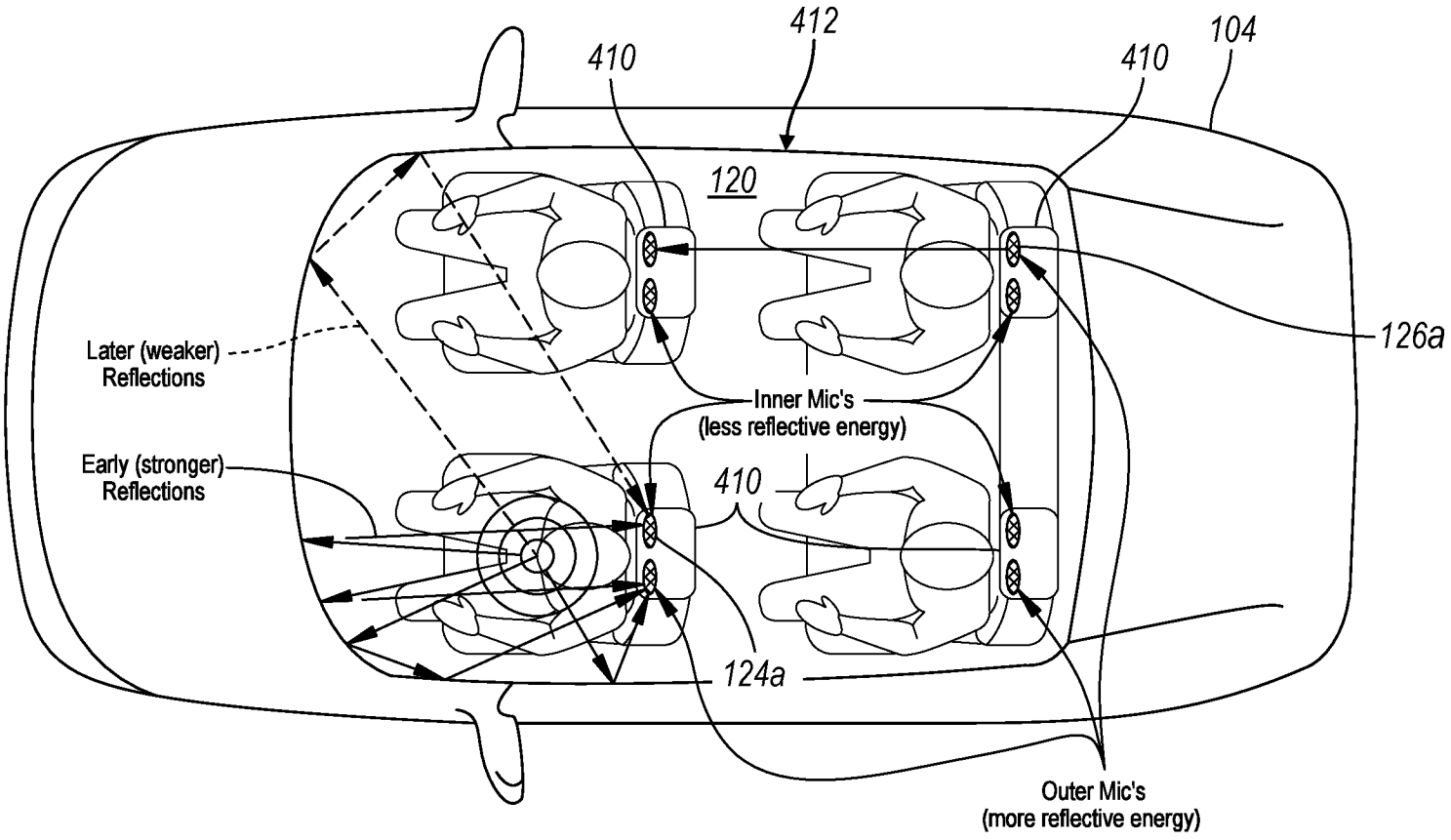
FIG. 4 illustrates an exemplary microphone placement, according to one or more embodiments of the present disclosure.

As also shown in FIG. 2, noise cancellation system 128 may include the first microphone array 124 and the second microphone array 126. The first microphone array 124 may include a plurality of small, embedded microphones strategically located in the vehicle cabin to receive speech from a near-end participant (i.e., driver or another occupant of the source vehicle) of the telecommunications exchange. The first microphone array 124 may be positioned as close to the near-end participant as possible, while being as far from reflective surfaces as possible. For instance, the first microphone array 124 may be embedded in a headrest or headliner or the like, as shown in FIG. 4. The second microphone array 126 may include a plurality of small, embedded microphones strategically located in the vehicle cabin to detect unwanted audio sources (e.g., road noise, wind noise, background speech, and multimedia content), collectively referred to as noise.

Both inputs to the first and second microphone arrays, near-end speech and noise, respectively, may be processed using the DSP 114. A set of first audio signals 209 (i.e., indicative of the near-end speech) from the first microphone array 124 may be fed into a first beamformer 210 for beamforming, while a set of second audio signals 211 (i.e., indicative of noise) may be fed into a second beamformer 212. Beamforming or spatial filtering is a signal processing technique used in sensor arrays for directional signal transmission or reception. This is achieved by combining elements in an array in such a way that signals at particular angles experience constructive interference while others experience destructive interference. Beamforming can be used at both the transmitting and receiving ends to achieve spatial selectivity. The improvement compared with omnidirectional reception/transmission is known as the directivity of the array. To change the directionality of the array when transmitting, a beamformer controls the phase and relative amplitude of the signal at each transmitter, to create a pattern of constructive and destructive interference in the wavefront. When receiving, information from different sensors is combined in a way where the expected pattern of radiation is preferentially observed.

The first beamformer 210 may output a near-end speech signal 213 indicative of the near-end speech detected by the first microphone array 124. Alternatively, the near-end speech signal 213 may be received by the DSP 114 directly from the first microphone array 124 or an individual microphone in the first microphone array. The second beamformer 212 may output a noise signal 218 indicative of the unpredictable, background noise detected by the second microphone array 126. Alternatively, the noise signal 218 may be received by the DSP 114 directly from the second microphone array 126 or an individual microphone in the second microphone array.

The near-end speech signal 213 may be received by an echo canceller 214 along with the digitally processed incoming telecommunications signal 112*a*' from the far-end participant 106. Echo cancellation is a method in telephony to improve voice quality by removing echo after it is already present. In addition to improving subjective quality, this process increases the capacity achieved through silence suppression by preventing echo from traveling across a network. There are various types and causes of echo with unique characteristics, including acoustic echo (sounds from a loudspeaker being reflected and recorded by a microphone, which can vary substantially over time) and line echo (electrical impulses caused by, e.g., coupling between the sending and receiving wires, impedance mismatches, electrical reflections, etc., which varies much less than acoustic echo). In practice, however, the same techniques are used to treat all types of echo, so an acoustic echo canceller can cancel line echo as well as acoustic echo. Echo cancellation involves first recognizing the originally transmitted signal that re-appears, with some delay, in the transmitted or received signal. Once the echo is recognized, it can be removed by subtracting it from the transmitted or received signal. Though this technique is generally implemented digitally using a digital signal processor or software, although it can be implemented in analog circuits as well.

The output of the echo canceller 214 may be mixed with the noise signal 218 (i.e., unpredictable noise) from the second beamformer 212 and an infotainment audio signal 220 (i.e., predictable noise) from the infotainment system 116 at a noise suppressor 216. Mixing the near-end speech signal 213 with the noise signal 218 and/or the infotainment audio signal 220 at the noise suppressor 216 can effectively cancel acoustic energy from one or more unwanted sources in the vehicle 104. The audio playing from a known audio stream (e.g., music, sound effects, and dialog from a film audio) in the vehicle's infotainment system 116 may be considered predictable noise and may be used as a direct input to the noise-cancellation system 128 and cancelled or suppressed from the near-end speech signal 213. Moreover, additional unwanted and unpredictable noise (e.g., children yelling and background conversations) captured by the embedded microphones may also be used as direct inputs to the noise-cancellation system 128. The unwanted noise may be cancelled or suppressed from the near-end speech signal 213 by the noise suppressor 216 based on the noise signal 218 and the infotainment audio signal 220 before being communicated to the far-end participant as an outgoing telecommunications signal 112*b*. Noise suppression is an audio pre-processor that removes background noise from the captured signal.

A noise-suppressed, near-end speech signal 213' may be output from the noise suppressor 216 and may be mixed with the processed incoming telecommunications signal 112*a*' from the far-end participant at an echo suppressor 222. Echo suppression, like echo cancellation, is a method in telephony to improve voice quality by preventing echo from being created or removing it after it is already present. Echo suppressors work by detecting a voice signal going in one direction on a circuit, and then inserting a great deal of loss in the other direction. Usually the echo suppressor at the far-end of the circuit adds this loss when it detects voice coming from the near-end of the circuit. This added loss prevents the speaker from hearing their own voice.

The output from the echo suppressor 222 may then undergo automatic gain control at an automatic gain controller (AGC) 224. The AGC 224 may provide a controlled signal amplitude at its output, despite variation of the amplitude in the input signal. The average or peak output signal level is used to dynamically adjust the input-to-output gain to a suitable value, enabling the circuit to work satisfactorily with a greater range of input signal levels. The output from the AGC 224 may then be received by an equalizer 226 to equalize the near-end speech signal. Equalization is the process of adjusting the balance between frequency components within an electronic signal. Equalizers strengthen (boost) or weaken (cut) the energy of specific frequency bands or "frequency ranges."

The output from the equalizer 226 may be sent to a loss controller 228 to undergo loss control. The output may then be passed through a comfort noise generator (CNG) 230. CNG 230 is a module that inserts comfort noise during periods that there is no signal received. CNG may be used in association with discontinuous transmission (DTX). DTX means that a transmitter is switched off during silent periods. Therefore, the background acoustic noise abruptly disappears at the receiving end (e.g. far-end). This can be very annoying for the receiving party (e.g., the far-end participant). The receiving party might even think that the line is dead if the silent period is rather long. To overcome these problems, "comfort noise" may be generated at the receiving end (i.e., far-end) whenever the transmission is switched off. The comfort noise is generated by a CNG. If the comfort noise is well matched to that of the transmitted background acoustic noise during speech periods, the gaps between speech periods can be filled in such a way that the receiving party does not notice the switching during the conversation. Since the noise constantly changes, the comfort noise generator 230 may be updated regularly.

The output from the CNG 230 may then be transmitted by the telecommunications system to the far-end participant of the telecommunications exchange as the outgoing telecommunications signal 112*b*. By cancelling noise inputs directly from the outgoing telecommunications signal, a user's far-end correspondent may be provided with much higher signal-to-noise ratio, call quality, and speech intelligibility.

Although shown and described as improving near-end speech intelligibility at a far-end participant of a telecommunications exchange, the noise-cancellation system 128 may be employed to improve near-end speech intelligibility at a far-end of any communications exchange. For instance, the noise-cancellation system 128 may be used in connection with virtual personal assistance (VPA) applications to optimize speech recognition at the far-end (i.e., a virtual personal assistant). Accordingly, background (unwanted) noise may be similarly suppressed or canceled from the near-end speech of a communications exchange with the VPA.

Figure 3:
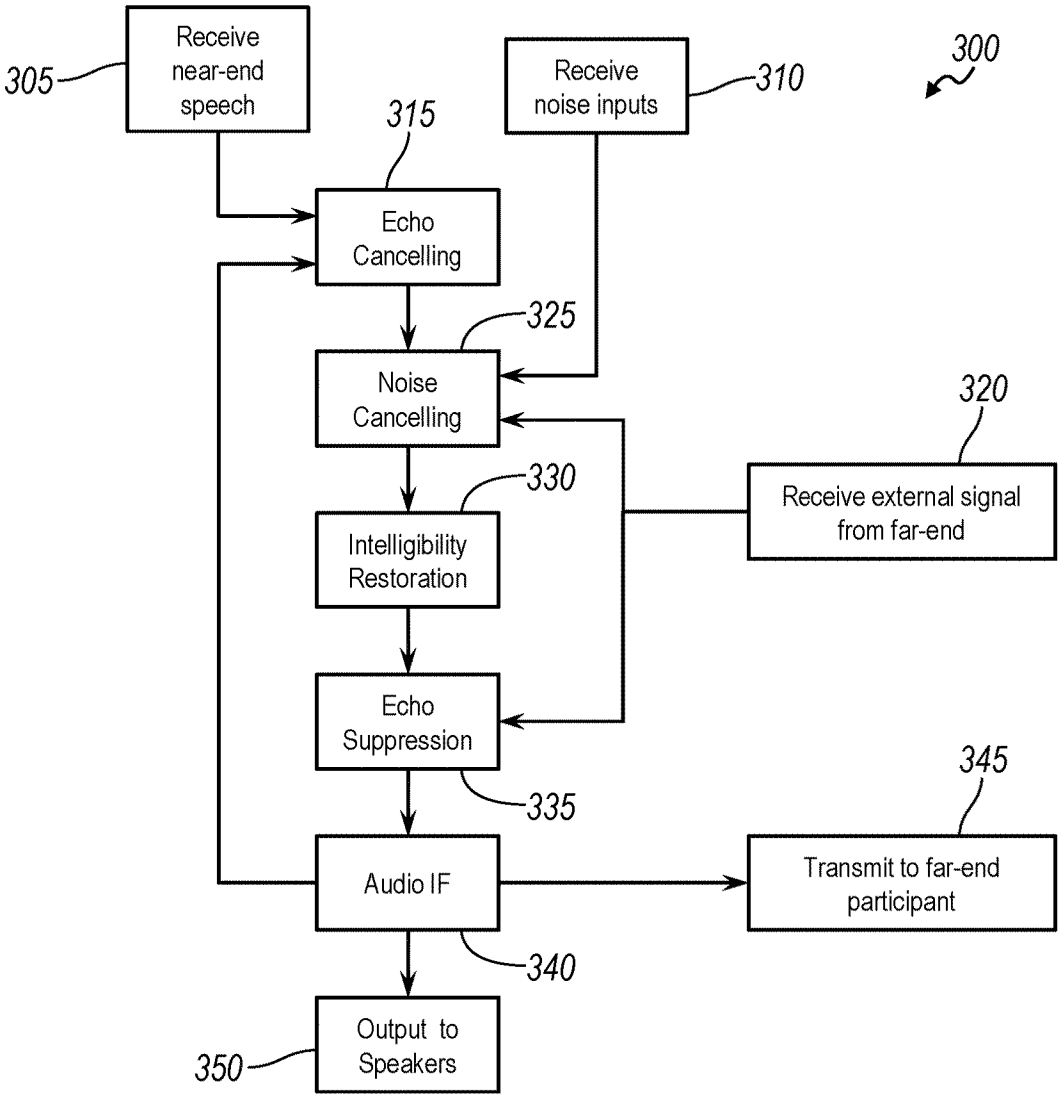
FIG. 3 is a simplified, exemplary flow diagram depicting a noise cancellation method 300 for far-end telecommunications, according to one or more embodiments of the present disclosure.

FIG. 3 is a simplified, exemplary flow diagram depicting a noise cancellation method 300 for far-end telecommunications. At step 305, near-end speech may be received at the noise cancellation system 128 by a microphone array, such as the first microphone array 124. Meanwhile, the noise cancellation system 128 may receive audio input streams from unwanted sources, such as unpredictable noise from the second microphone array 126 and/or predictable noise from the infotainment system 116, as provided at step 310. The near-end speech may be processed into an outgoing telecommunications signal 112*b* for receipt by a far-end participant of a telecommunications exchange. Accordingly, at step 315, the near-end speech signal may undergo an echo cancelling operation to improve voice quality by removing echo after it is already present. As previously described, echo cancellation involves first recognizing the originally transmitted signal that re-appears, with some delay, in the transmitted or received signal. Once the echo is recognized, it can be removed by subtracting it from the transmitted or received signal.

The near-end speech signal may be received at a noise suppressor along with the noise inputs received at step 310 and an incoming telecommunications signal for the far-end participant (step 320). During noise cancelling, the noise may be cancelled or suppressed from the near-end speech signal, as provided at step 325. At step 330, intelligibility of the speech in the near-end speech signal may be restored by reducing or cancelling the effects of masking by extraneous sounds. The near-end speech signal may then undergo echo suppression using the incoming telecommunications signal, as provided at step 335. As previously described, echo suppression, like echo cancellation, is a method in telephony to improve voice quality by preventing echo from being created or removing it after it is already present. The near-end speech signal may undergo additional audio filtering at step 340 before it is transmitted to the far-end participant (step 345) via the telecommunications network as an outgoing telecommunications signal. Meanwhile, the incoming telecommunications signal may be played in the vehicle cabin through speakers (step 350).

FIG. 4 illustrates an exemplary microphone placement within the cabin 120 of the vehicle 104, according to one or more embodiments of the present disclosure. For example, a first microphone 124*a*, from the first microphone array 124, for picking up near-end speech may be embedded in one or more headrests 410. A second microphone 126*a*, from the second microphone array 126, for picking up noise may also be embedded in one or more headrests 410, a headliner (not shown), or the like. As shown, microphones positioned toward the inside of passengers with respect to the vehicle cabin 120, as near a user's mouth as possible, may minimize the reflective energy in the signal, as compared to microphones positioned to the outside of passengers with respect to the vehicle cabin. This is because microphones positioned to the outside of passengers with respect to the vehicle cabin may receive more reflective energy from reflective surfaces 412, such as glass, enclosing the vehicle cabin 120. Minimizing the reflective energy in the near-end speech signal may increase speech intelligibility at the far-end of a telecommunication. The placement and/or location of the microphones shown in FIG. 4 is an example only. The exact location of the microphone arrays will depend on boundaries and coverage area inside a vehicle.

Figure 5:
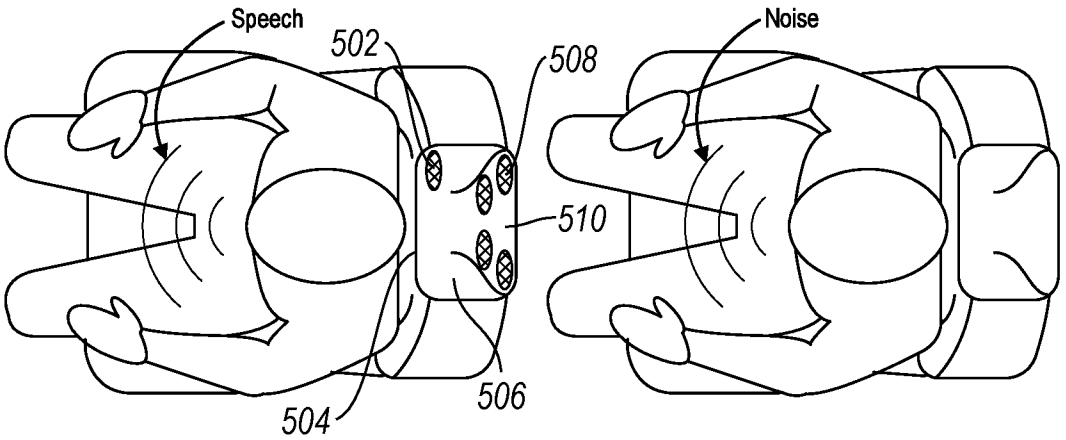
FIG. 5 illustrates an exemplary set-up for a headrest-based telecommunications system for a vehicle, according to one or more embodiments of the present disclosure.
Figure 6:
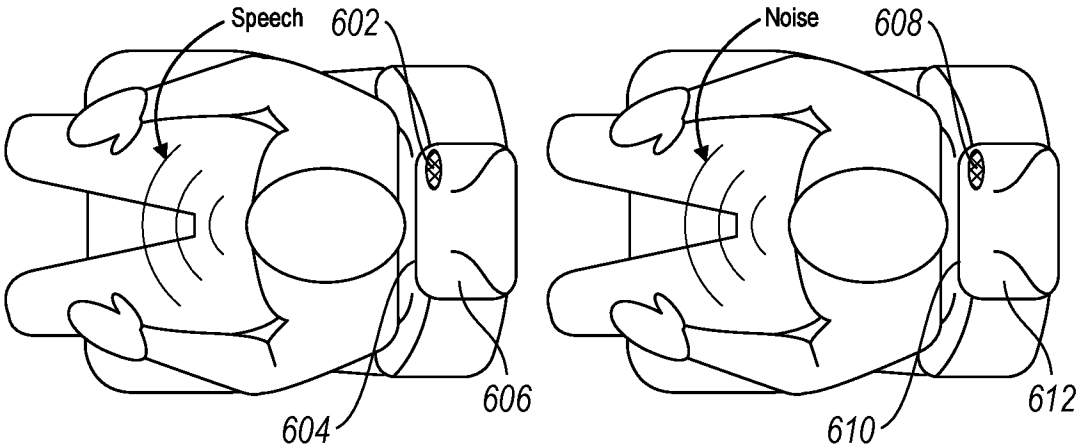
FIG. 6 illustrates another exemplary set-up for a headrest-based telecommunications system for a vehicle, according to one or more embodiments of the present disclosure.

FIG. 5 illustrates an exemplary set-up for a headrest-based telecommunications system for a vehicle. A first, forward-facing microphone array 502 may be placed near a front 504 of a front passenger headrest 506 for receiving near-end speech of a telecommunications exchange. A second, rearward-facing microphone array 508 may be placed near a back 510 of the front passenger headrest 506 for receiving noise, including background speech. FIG. 6 illustrates another exemplary set-up for a headrest-based telecommunications system for a vehicle. A first, forward-facing microphone array 602 may be placed near a front 604 of a front passenger headrest 606 for receiving near-end speech of a telecommunications exchange. A second, forward-facing microphone array 608 may be placed near a front 610 of a rear passenger headrest 612 for receiving noise, including background speech. As with FIG. 4, the exact location of the microphone arrays illustrated in FIGS. 5 and 6 will depend on boundaries and coverage area inside a vehicle.

Figure 7:
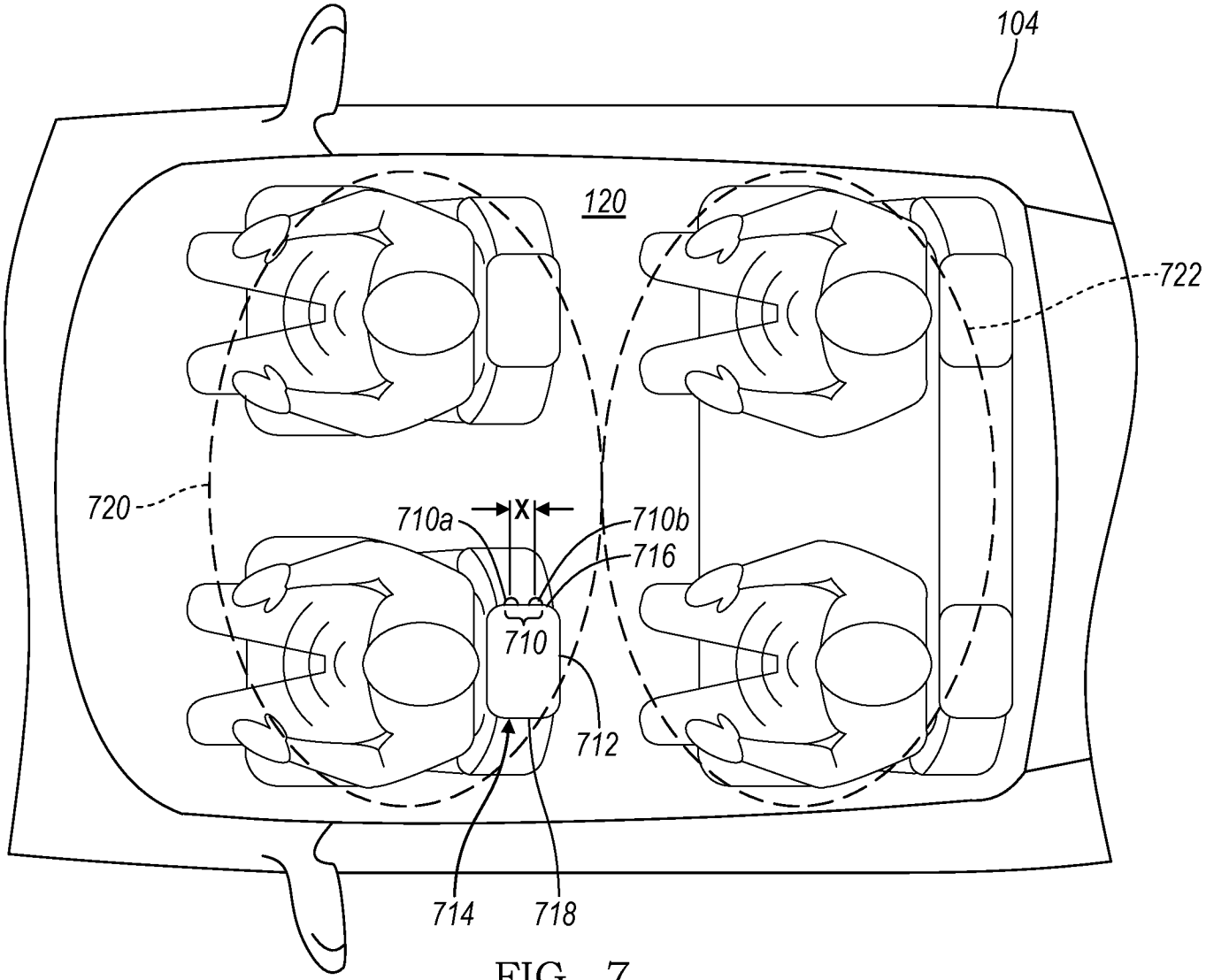
FIG. 7 is a plan view of a vehicle including at least one headrest microphone array for use in an in-cabin noise cancellation system, according to one or more embodiments of the present disclosure.

FIGS. 7-10 depict various plan views of sample microphone configurations for the noise cancellation system 128 (not shown) within the cabin 120 of a vehicle, such as vehicle 104. As with the microphones and microphone arrays described in connection with FIGS. 1 and 2, the various microphone arrays and/or individual microphones shown in FIGS. 7-10 may be in communication with the digital signal processor 114 to work in connection with a vehicle communications system, such as an in-car communications system or telecommunications system 110. For example, FIG. 7 is a plan view of the vehicle 104 depicting a first sample microphone configuration, in accordance with one or more embodiments of the present disclosure. As shown, the noise cancellation system 128 (not shown) may include at least one microphone array 710 including at least two microphones—a first microphone 710*a* and a second microphone 710*b*. The first and second microphones may be mounted to an external surface 712 of a first headrest 714 at spaced-apart locations. The first headrest 714 may be a driver's side headrest.

The external surface 712 of the first headrest 714 may include an inboard side surface 716 and an outboard side surface 718. The inboard side surface 716 may be nearer a center of the vehicle cabin 120 than the outboard side surface 718, which is nearer a side of the vehicle 104, including reflective surfaces 412 (see FIG. 4). As shown in FIG. 7, the first and second microphones 710*a,b* may be positioned flush on the inboard side surface 716 of the first headrest 714. The first and second microphones 710*a,b* may be spaced apart in at least a longitudinal direction with respect to the vehicle 104. Thus, a distance separating the first and second microphones may include at least a longitudinal distance X to create at least a first listening zone 720 and a second listening zone 722 oriented in the longitudinal direction. The longitudinal distance X between the two microphones in the microphone array 710 may give an indication of the direction of incoming sound, generally front or back. Accordingly, the first listening zone 720 may comprise a forward region of the passenger cabin 120, such as a region encompassing a front seating row, while the second listening zone 722 may comprise a region that is oriented rearward of the first listening zone 720, such as a region encompassing a rear passenger seat. In an embodiment, the longitudinal distance X between the first and second microphones 710*a,b* may be approximately one inch, though other distances between the microphones may be employed to give an indication of the direction of incoming sound, forward or rearward.

The digital signal processor 114 may be programmed to receive microphone signals indicative of sound from the microphone array 710, as shown in FIG. 2, and identify whether the sound is received from a direction of the first listening zone 720 or the second listening zone 722 based on the microphone signals. For instance, the digital signal processor 114 may compare the microphone signals from the first and second microphones 710*a,b* and localize the direction of the sound from either the first listening zone or the second listening zones based on a time difference of arrival of the microphone signals at each of the two microphones. Moreover, the digital signal processor 114 may suppress or cancel the microphone signals indicative of sound from (the direction of) the second listening zone 722, which may be equated with unwanted or disturbing background noise. On the other hand, the digital signal processor 114 may transmit microphone signals indicative of sound from (the direction of) the first listening zone 720, which may be equated with wanted, near-end speech, to a far-end participant in a communications exchange.

According to an embodiment, the first and second microphones 710*a,b* may be omnidirectional microphones. According to another embodiment, the first and second microphones 710*a,b* may be directional microphones having a directivity in the direction of the corresponding listening zones. Accordingly, incoming sound may be attenuated based on the directivity of the microphones such that sound from the first listening zone 720 may be transmitted to a far-end participant while sound from the second listening zone 722 may be suppressed.

Figure 8:
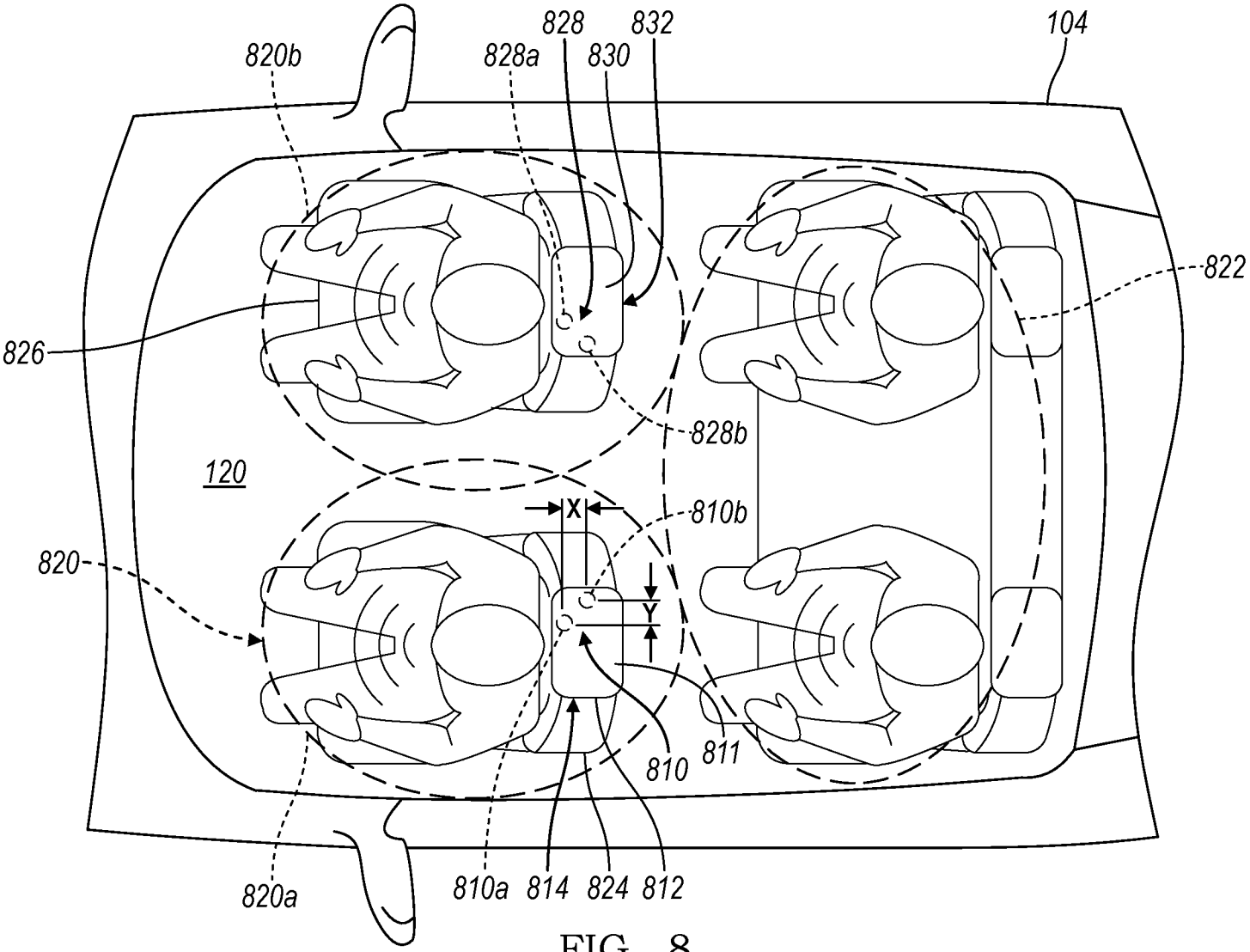
FIG. 8 is another plan view of a vehicle including at least one headrest microphone array for use in an in-cabin noise cancellation system, according to one or more embodiments of the present disclosure.

FIG. 8 is a plan view of the vehicle 104 depicting another sample microphone configuration, in accordance with one or more embodiments of the present disclosure. As shown, the noise cancellation system 128 (not shown) may include at least a first microphone array 810 including at least two microphones—a first microphone 810*a* and a second microphone 810*b*—mounted to a bottom surface 811 of an external surface 812 of a first headrest 814. Similar to FIG. 7, the first and second microphones 810*a,b* may be spaced apart in a longitudinal direction with respect to the vehicle 104. Thus, a distance separating the first and second microphones 810*a,b* may include at least a longitudinal distance X to create at least a first listening zone 820 and a second listening zone 822 oriented in the longitudinal direction. As described with respect to FIG. 7, the digital signal processor 114 may be programmed to receive microphone signals indicative of sound from the microphone array 810, as shown in FIG. 2, and identify whether the sound is received from a direction of the first listening zone 820 or the second listening zone 822 based on the microphone signals. Moreover, the digital signal processor 114 may suppress or cancel the microphone signals indicative of sound from (the direction of) the second listening zone 822, which may be equated with unwanted or disturbing background noise. On the other hand, the digital signal processor 114 may transmit microphone signals indicative of sound from (the direction of) the first listening zone 820, which may be equated with wanted, near-end speech, to a far-end participant in a communications exchange.

As shown in FIG. 8, the first and second microphones 810*a,b* may also be spaced apart in a lateral direction with respect to the vehicle 104. Thus, the distance separating the first and second microphones 810*a,b* may further include a lateral distance Y such that the first listening zone 820 comprises two listening subzones oriented in a lateral direction with respect to the vehicle 104. For instance, a first listening subzone 820*a* may encompass a region surrounding a driver's seat 824, while a second listening subzone 820*b* may encompass a region surrounding a front passenger seat 826. The lateral distance Y between the two microphones 810*a,b* in the first microphone array 810 may give an indication of the direction of incoming sound, generally left or right, such that the digital signal processor 114 may further identify whether the sound is received from a direction of the first listening subzone 820*a* or the second listening subzone 820*b* based on the microphone signals. Moreover, the digital signal processor 114 may be programmed to suppress or cancel microphone signals indicative of sound from (the direction of) the second listening subzone 820*b*, which may also be equated with unwanted or disturbing background noise. On the other hand, the digital signal processor 114 may transmit microphone signals indicative of sound from (the direction of) the first listening subzone 820*a*, which may be equated with wanted, near-end speech, to a far-end participant in a communications exchange.

As is further shown in FIG. 8, the noise cancellation system may include a second microphone array 828 including at least two microphones—a first microphone 828*a* and a second microphone 828*b*—mounted to a bottom surface 830 of a second headrest 832, which is laterally adjacent to the first headrest 814. The second microphone array's configuration may mirror that of the first microphone array. Accordingly, the first and second microphones 828*a,b* in the second microphone array 828 may be also be spaced apart in both the longitudinal direction and the lateral direction to give further indication of the direction of incoming sound, generally left or right, such that the digital signal processor 114 may further identify whether the sound is received from a direction of the first listening subzone 820*a* or the second listening subzone 820*b* based on the microphone signals. The microphones in the first and/or second microphone arrays may be either omnidirectional or directional microphones.

Figure 9:
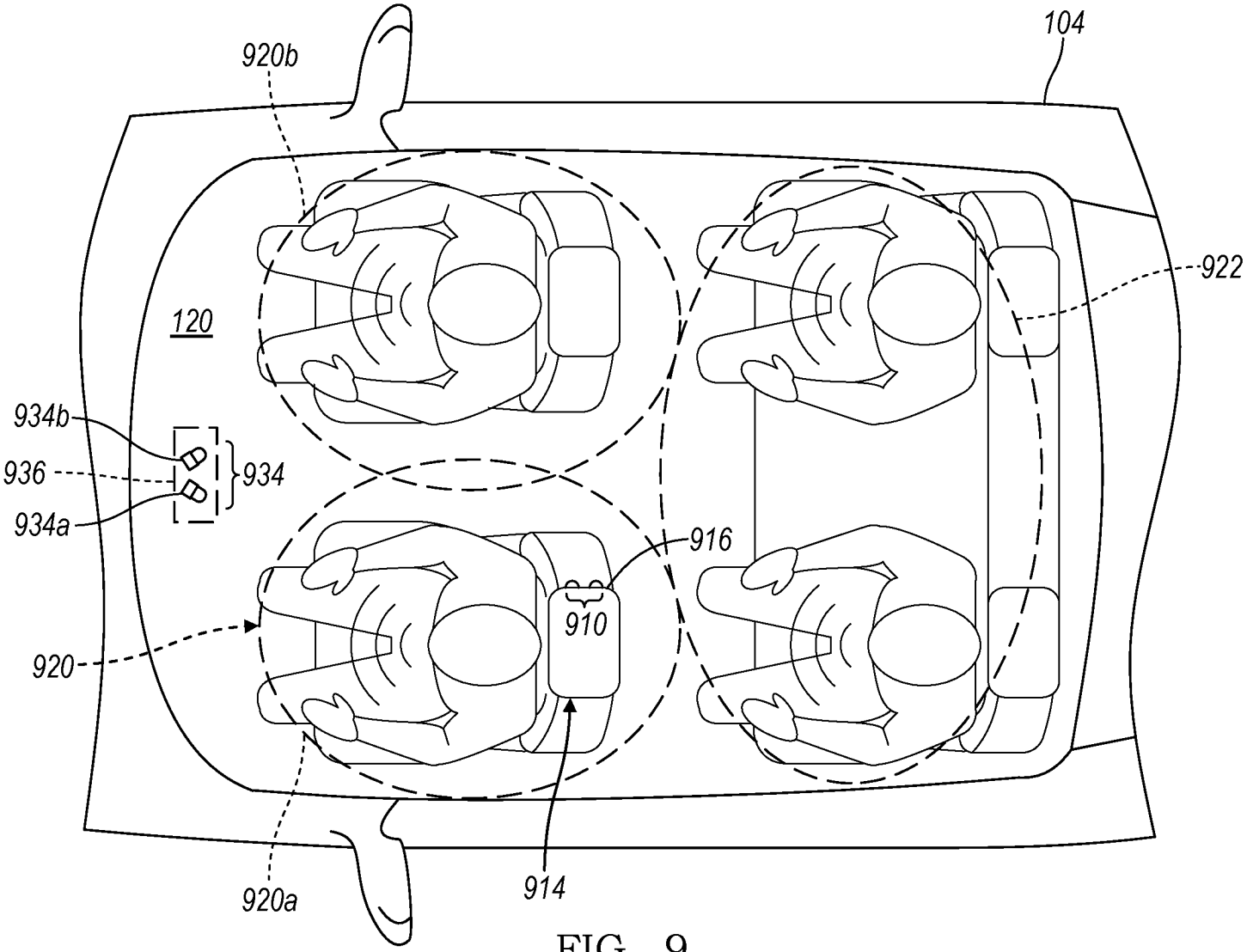
FIG. 9 is yet another plan view of a vehicle including at least one headrest microphone array and a rearview mirror assembly microphone array for use in an in-cabin noise cancellation system, according to one or more embodiments of the present disclosure.

FIG. 9 depicts yet another sample microphone configuration similar to the three-zone configuration shown in FIG. 8. As shown, a first microphone array 910 may be mounted to an inboard side surface 916 of a headrest 914, such as the microphone array shown in FIG. 7. Similar to FIG. 7, the first microphone array 910 may include a first microphone 910*a* and a second microphone 910*b* positioned on the inboard side surface 916 at spaced-apart locations, separated by a distance in the longitudinal direction to give an indication of the direction of incoming sound, forward or rearward. Thus, as previously described, the longitudinal separation of the first and second microphones 910*a,b* may create a first listening zone 920 and a second listening zone 922 oriented in the longitudinal direction. A second microphone array 934, including first and second microphones 934*a,b*, may be disposed in a rearview mirror assembly 936 rather than in the second headrest (as in FIG. 8) to give an indication of the direction of incoming sound, left or right, such that the digital signal processor 114 may further identify whether the sound is received from a direction of a first listening subzone 920*a* or a second listening subzone 920*b* based on the microphone signals. The first and second microphones 910*a,b* in the first microphone array 910 may be omnidirectional microphones. Moreover, the first and second microphones 934*a,b* in the second microphone array 934 may be directional microphones.

Figure 10:
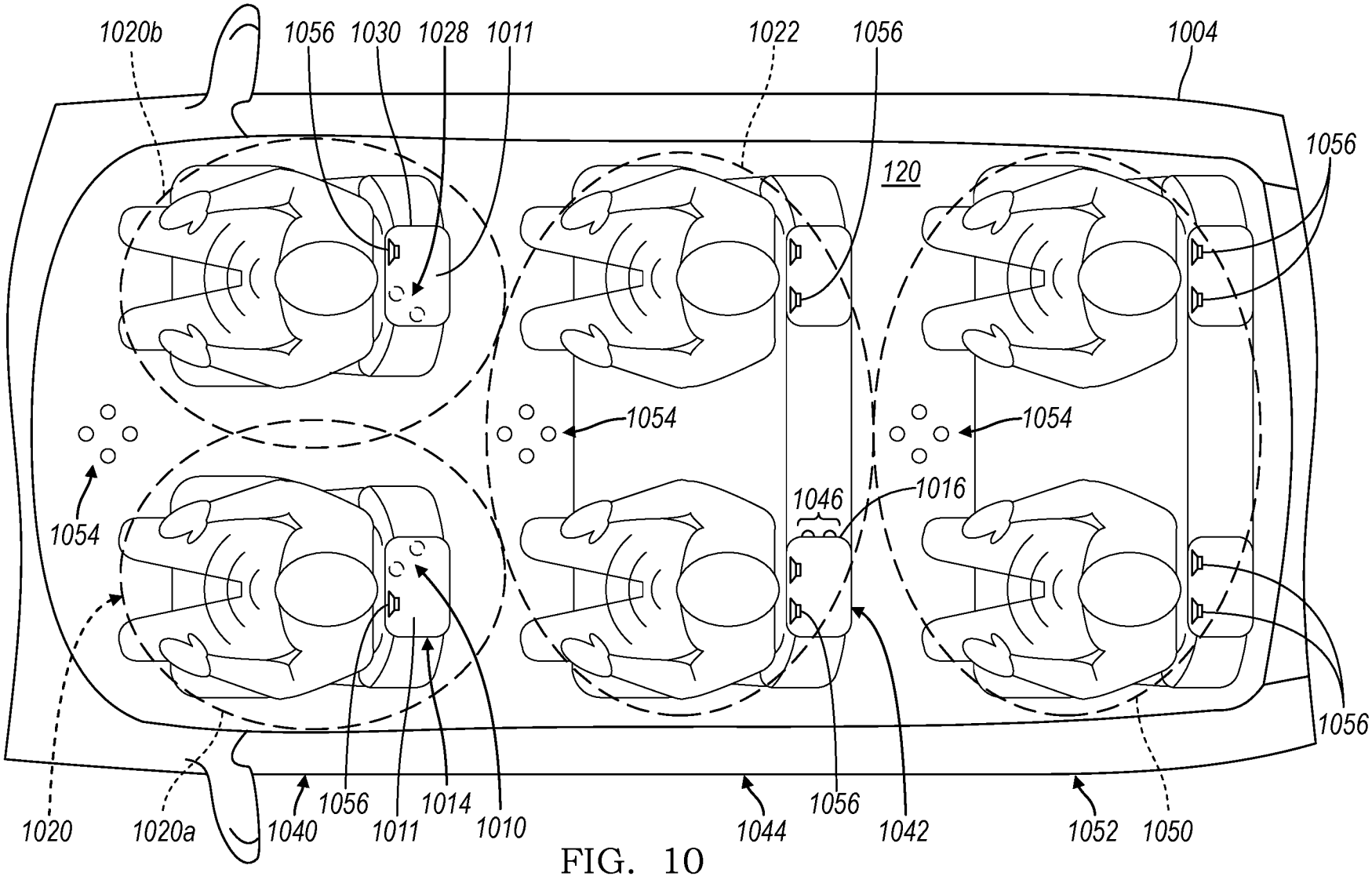
FIG. 10 is still yet another plan view of a vehicle including a plurality of various headrest microphone arrays for use in an in-cabin noise cancellation system, according to one or more embodiments of the present disclosure.

FIG. 10 is a plan view of a vehicle 1004 depicting yet another sample microphone configuration, in accordance with one or more embodiments of the present disclosure. As shown, the vehicle 1004 may include three rows of seating. The microphone configuration illustrated in FIG. 10 may employ a combination of various configurations described above with respect to FIGS. 7-9. For instance, a first row of seating 1040 may include a first microphone array 1010 in a first headrest 1014 and a second microphone array 1028 in a second headrest 1030, such as is illustrated in FIG. 8. Accordingly, microphones in each of the first and second microphone arrays 1010, 1028 may be mounted to a bottom surface 1011 of each corresponding headrest and spaced apart in both the longitudinal and lateral directions. The lateral spacing may create a first listening zone 1020 comprising a first listening subzone 1020*a* and a second listening subzone 1020*b* having lateral orientation, as previously described. Moreover, the longitudinal spacing may create a second listening zone 1022 rearward of the first listening zone 1020.

At least one headrest 1042 in a second row of seating 1044 may include a third microphone array 1046 similar to the microphone array 710 depicted in FIG. 7. Accordingly, microphones in the third microphone array 1046 may be mounted to an inboard side surface 1016 of the headrest 1042 and be spaced apart in at least the longitudinal direction to create a third listening zone 1050, rearward of the second listening zone 1022, that encompasses a third row of seating 1052. The vehicle 1004 may include additional microphone arrays 1054 positioned in the vehicle's ceiling or headliner (not shown), generally along a centerline of the vehicle. These additional microphone arrays 1054 may include three or four (as shown) microphones, which may be omnidirectional. All the various microphone arrays shown in FIG. 10 may form part of the noise cancellation system 128 and may cooperate with the digital signal processor 114 in a similar fashion as described in connection with FIGS. 7-9. Additionally, one or more of the headrests shown in FIG. 10 may further include at least one speaker 1056. The headrest-mounted speakers 1056 may be employed to transmit sound from a far-end participant of a communications exchange.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A noise cancellation system for a vehicle comprising:

at least one microphone array having at least two microphones mounted to a first headrest and spaced apart in a longitudinal direction, wherein a distance separating the two microphones creates at least a first listening zone and a second listening zone, wherein the second listening zone is oriented in the longitudinal direction relative to the first listening zone; and a digital signal processor programmed to:

receive microphone signals indicative of sound from the at least one microphone array; and identify whether the sound is received from the first listening zone or the second listening zone based on the microphone signals by comparing the microphone signals from the two microphones; and localizing a direction of the sound from either the first listening zone or the second listening zone based on a time difference of arrival of the microphone signals at each of the two microphones.

2. The noise cancellation system of claim 1, wherein the microphones are positioned within the first listening zone, and wherein the digital signal processor is further programmed to suppress sound received from the second listening zone.

3. The noise cancellation system of claim 2, wherein the second listening zone is rearward of the first listening zone.

4. The noise cancellation system of claim 1, wherein the microphones are omnidirectional.

5. The noise cancellation system of claim 1, wherein the microphones are located on an inboard side surface of the first headrest.

6. The noise cancellation system of claim 1, wherein the microphones are located on a bottom surface of the first headrest.

7. The noise cancellation system of claim 6, wherein the two microphones are further separated in a lateral direction with respect to the vehicle, and wherein the first listening zone comprises two listening subzones oriented in the lateral direction relative to each other.

8. The noise cancellation system of claim 7, wherein the digital signal processor is further programmed to suppress sound received from one of the listening subzones.

9. The noise cancellation system of claim 6, further comprising:

a second microphone array including at least two microphones, the at least two microphones mounted to a bottom surface of a second headrest laterally adjacent to the first headrest, wherein the two microphones in the second headrest are spaced apart in both a longitudinal direction and a lateral direction relative to each other.

10. The noise cancellation system of claim 1, further comprising:

a second microphone array including at least two microphones mounted in a rearview mirror assembly, wherein the at least two microphones are spaced apart in a lateral direction with respect to the vehicle.

11. The noise cancellation system of claim 10, wherein the at least two microphones in the rearview mirror assembly are directional microphones such that the first listening zone comprises two listening subzones oriented in the lateral direction with respect to the vehicle.

12. A microphone array for a communications system associated with a vehicle, the microphone array comprising:

a first microphone mounted adjacent to an external surface of a headrest;

a second microphone mounted adjacent to the external surface of the headrest and spaced-apart from the first microphone in a longitudinal direction;

wherein at least a longitudinal distance separates the first microphone from the second microphone to create at least a first listening zone and a second listening zone oriented in a longitudinal direction with respect to the vehicle a digital signal processor programmed to:

receive microphone signals indicative of sound from the at least one microphone array; and identify whether the sound is received from the first listening zone or the second listening zone based on the microphone signals by comparing the microphone signals from the two microphones; and localizing a direction of the sound from either the first listening zone or the second listening zone based on a time difference of arrival of the microphone signals at each of the two microphones.

13. The microphone array of claim 12, wherein the first microphone and the second microphone are omnidirectional microphones.

14. The microphone array of claim 12, wherein the first and second microphones are located on an inboard side surface of the headrest.

15. The microphone array of claim 12, wherein the first and second microphones are located on a bottom surface of the first headrest.

16. The microphone array of claim 15, wherein the first microphone and the second microphone are further separated by a lateral distance such that the first listening zone comprises two listening subzones oriented in a lateral direction with respect to the vehicle.

* * * * *